US008074510B2

(12) United States Patent
Slater et al.

(10) Patent No.: US 8,074,510 B2
(45) Date of Patent: Dec. 13, 2011

(54) HIGH PRESSURE SCREEN FLOW-THROUGH TESTING DEVICE

(75) Inventors: Kenneth Slater, Sealy, TX (US); Michael T. Darring, New Orleans, LA (US); Marian Baranowski, Houston, TX (US)

(73) Assignee: M-I LLC, Houston, TX (US)

( * ) Notice: Subject to any disclaimer, the term of this patent is extended or adjusted under 35 U.S.C. 154(b) by 525 days.

(21) Appl. No.: 12/334,174

(22) Filed: Dec. 12, 2008

(65) Prior Publication Data

US 2009/0151443 A1 Jun. 18, 2009

Related U.S. Application Data

(60) Provisional application No. 61/012,939, filed on Dec. 12, 2007.

(51) Int. Cl.
*E21B 49/10* (2006.01)

(52) U.S. Cl. ..... 73/152.26

(58) Field of Classification Search ..... 73/38, 152.25, 73/152.26

See application file for complete search history.

(56) References Cited

U.S. PATENT DOCUMENTS

| | | | | |
|---|---|---|---|---|
| 3,320,792 | A | 5/1967 | Peranio | |
| 3,864,970 | A * | 2/1975 | Bell | 73/152.25 |
| 4,701,861 | A | 10/1987 | Kauke | |
| 4,979,390 | A * | 12/1990 | Schupack et al. | 73/38 |
| 5,520,248 | A * | 5/1996 | Sisson et al. | 166/250.02 |
| 5,581,017 | A | 12/1996 | Bejtlich, III | |
| 6,543,276 | B2 * | 4/2003 | Murphy et al. | 73/61.63 |

FOREIGN PATENT DOCUMENTS

| | | |
|---|---|---|
| GB | 109074 | 8/1917 |
| WO | 01/39870 A2 | 6/2001 |

OTHER PUBLICATIONS

Combined Search and Examination Report for Application No. GB0822747.2, mailed on Apr. 16, 2009 (5 pages).

* cited by examiner

*Primary Examiner* — John Fitzgerald
(74) *Attorney, Agent, or Firm* — Osha Liang LLP

(57) ABSTRACT

A screen test apparatus includes a test cell disposed within a pressure vessel, a piston disposed within the pressure vessel, wherein the piston is in sealing contact with an inner surface of the pressure vessel, and a screen assembly disposed in an end of the test cell. The screen assembly includes a mount collar, a screen disposed in the mount collar, and an end cap adjacent the screen which includes grooves in a face adjacent the screen and passages extending through the end cap, wherein the screen assembly is configured to fully support the screen while allowing a fluid to pass through the screen.

18 Claims, 5 Drawing Sheets

HIGH PRESSURE SCREEN FLOW-THROUGH TESTING DEVICE

CROSS-REFERENCE TO RELATED APPLICATIONS

This application claims priority under 35 U.S.C. §119(e) to U.S. Provisional Application Ser. No. 61/012,939, filed on Dec. 12, 2007, which is hereby incorporated in its entirety.

BACKGROUND

1. Field of the Disclosure

Embodiments disclosed herein relate generally to downhole screens. More particularly, embodiments disclosed herein relate to apparatus and methods for a high pressure screen test fixture.

2. Background Art

During drilling of a wellbore, the pressure balance between the circulating drilling fluids and that of the formation being drilled may be maintained in an underbalanced or an overbalanced mode. Underbalanced drilling is a method of drilling a desired subterranean formation where the hydrostatic pressure exerted by a column of drilling fluid in the drill string is less than the natural pressure (pore pressure) inherent in the subterranean formation being drilled. Underbalanced drilling may prevent damage to the desired subterranean formation and in particular low pressure formations. Typically, the pressure differential is set to provide a margin above the pressure at which wellbore collapse might occur. The introduction of sufficient air, nitrogen or other gases to the drilling fluids may reduce the density of the commingled fluids and effectively decrease hydrostatic pressure. Other low density fluids, such as emulsions, foams and mists, may be used as a drilling fluid to achieve an underbalanced condition.

In overbalanced drilling, fluid in an annulus of a well is used to exert a pressure that is greater than the formation pressure. The mud weight, or density, may be calculated to give the appropriate pressure gradient across the exposed formation to provide the optimum fluid migration rate into the least stable horizon of the exposed formation. Thus, the pressure that is exerted by the annular fluid prevents formation fluids from exiting the well and may provide support for the wellbore. A drawback to this technique is that particulates added to increase the weight of the fluid (and, thus, increase its downhole pressure), as well as other particulates, emulsified fluids, and surfactants, may be pushed into the formation and damage the formation. The well may also need to be tested after overbalanced drilling to check for formation damage.

After the desired borehole in the hydrocarbon reservoir is drilled, production tubulars and/or screens may be run to the bottom of the borehole and placed against the desired formations for hydrocarbon production. When the hydrocarbon-bearing formations consist of poorly cemented sands, sand control methods or devices are used to prevent sand particles in the formation from entering and plugging the production screens and tubulars in order extend the life of the well. One typical sand control method includes filling an annular space between the wellbore and the production screens with specially sized sand, which is usually larger than the formation sand and commonly known as gravel pack sand. The process of placing the sized sand behind the production screen is known as a gravel pack operation.

Gravel packing involves the complete placement of selected gravel across the production interval to prevent production of formation fines or sands. Any gap or interruption in the pack coverage may allow undesirable sand to enter the producing system. Referring to FIG. 1, a wellbore 100 with a gravel-pack packer 102 is shown. Gravel-pack packer 102 may be set in casing 104 with gravel-pack screen 106 being placed in a perforated zone 108. Gravel 110 may be placed in casing 104 and may flow into perforations 108.

In addition to the appropriate use of underbalanced or overbalanced drilling, another way to protect the formation is by forming a filter cake on the surface of the wellbore, or on the downhole screens described above. A filter cake is a tough, dense, practically insoluble residue composed of either soluble or insoluble materials that reduces the permeability of the formation and which is formed when particles or emulsified fluids suspended in a drilling fluid coat or plug the pores in the subterranean formation while drilling overbalanced. Filter cakes may be formed a number of ways known in the art, including the use of both clay and non-clay based drilling fluids. Sealing off producing formations using a filter cake may also be desired in order to prevent fluid loss and possible damage to the formation. Filter cakes can prevent loss of drilling fluids to the formation by substantially preventing fluids from passing between the wellbore and the formation. Formation of a filter cake may also be desired prior to completion or workover of a well. In this case, a filter cake may be formed on the inside of the production, or gravel pack, screen for the purpose of limiting fluid loss to the reservoir through the screen.

Advances in oilfield technology have led to drilling of deeper wells in increased water depths. As a result, drilling and workover operations often encounter declining formation pore pressure as existing producing wells are depleted. A higher overbalance condition is therefore required for successful workover operations. Accordingly, there exists a need for screens suitable for use at increased working pressures. Likewise, there exists a need for apparatus and methods to test screens and drilling/workover fluids at these increased working pressures.

SUMMARY OF THE DISCLOSURE

In one aspect, embodiments disclosed herein relate to a screen test apparatus including a test cell disposed within a pressure vessel, a piston disposed within the pressure vessel, wherein the piston is in sealing contact with an inner surface of the pressure vessel, and a screen assembly disposed in an end of the test cell. The screen assembly includes a mount collar, a screen disposed in the mount collar, and an end cap adjacent the screen including grooves in a face adjacent the screen and passages extending through the end cap, wherein the screen assembly is configured to fully support the screen while allowing a fluid to pass through the screen.

In other aspects, embodiments disclosed herein relate to a screen test system including a pumping assembly, the pumping assembly including a pump, a fluid reservoir, and a pressure regulator. The screen test system further includes a screen test apparatus including a test cell disposed within a pressure vessel, a piston disposed within the pressure vessel, the piston in sealing contact with an inner surface of the pressure vessel, and a screen assembly disposed in the test cell. The screen assembly includes a mount collar, a screen disposed in the mount collar, and an end cap adjacent the screen including grooves in a face adjacent the screen and passages extending through the end cap. Screen test system further includes a fluid line connecting the pumping assembly to the screen test apparatus, a workover fluid to apply pressure to the screen assembly, and a hydraulic fluid to apply pressure to the piston.

In other aspects, embodiments disclosed herein relate to a method of testing a screen with high pressure, the method including disposing a test cell and a piston within a pressure vessel such that the piston is in scaling contact with an inner surface of the pressure vessel, disposing a screen assembly in the test cell, the screen assembly including a mount collar, a screen disposed in the mount collar, and an end cap adjacent the screen which includes grooves in a face adjacent the screen and passages extending through the end cap. The method further includes filling a volume in the pressure vessel between the piston and the test cell with a workover fluid, the workover fluid configured to apply a pressure against the screen assembly, filling a remaining volume in the pressure vessel with a hydraulic fluid, the hydraulic fluid configured to apply pressure to the piston, applying pressure from a pumping assembly with the hydraulic fluid to the piston, and applying pressure with the workover fluid to the screen assembly, wherein the workover fluid applied to the screen assembly is pressurized to determine sealing characteristics.

Other aspects and advantages of the invention will be apparent from the following description and the appended claims.

DETAILED DESCRIPTION

Embodiments disclosed herein relate generally to downhole screens. More particularly, embodiments disclosed herein relate to apparatus and methods for a high pressure screen test fixture.

In downhole wellbore operations, fluid loss from the wellbore into a reservoir may be prevented by gravel-pack screens as previously described. In the event of a workover, which is common and well known in the art, a filter cake as described above, or carbonate particles may be used to temporarily "plug" the screens downhole, thereby preventing workover fluids from entering the reservoir. With higher pressures becoming more common, test apparatus in accordance with embodiments disclosed herein may be used to simulate downhole conditions on screens.

Figure 1:
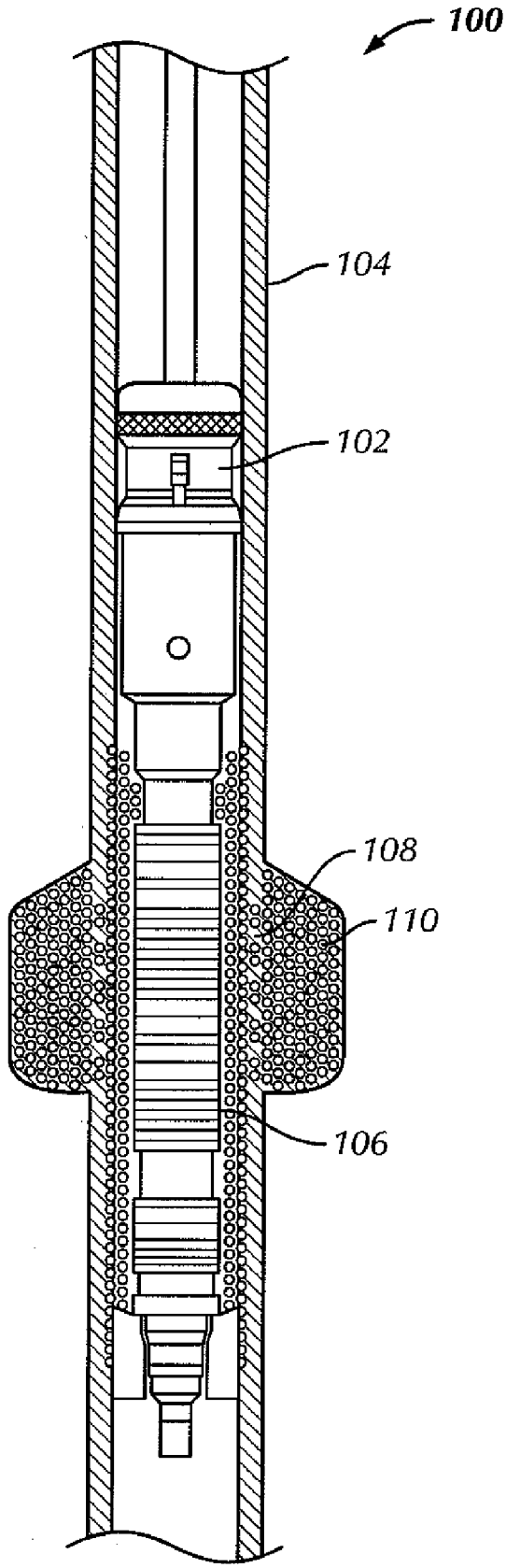
FIG. 1 is a downhole view of a conventional gravel-pack.
Figure 2:
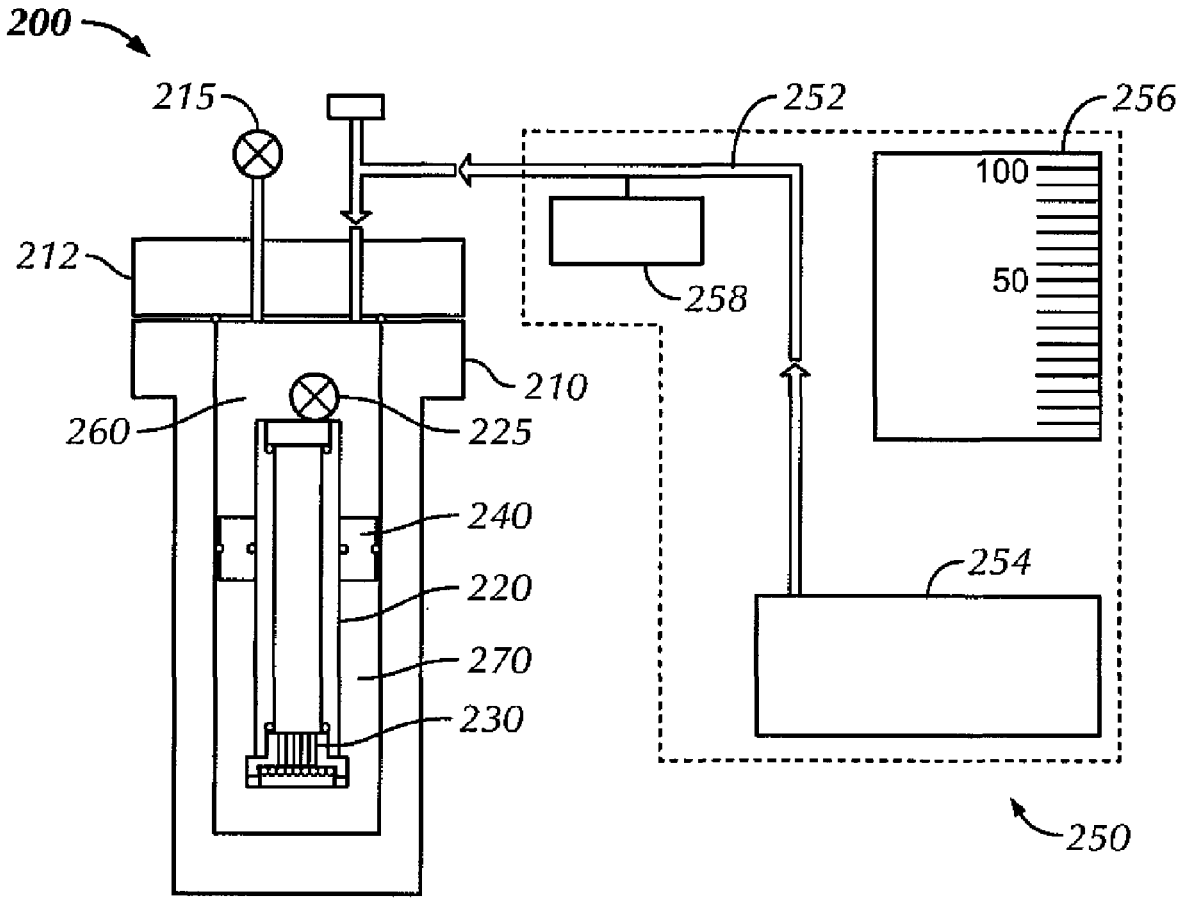
FIG. 2 is a schematic view of a high pressure screen test apparatus in accordance with embodiments of the present disclosure.

Referring to FIG. 2, a schematic diagram of a high pressure screen test apparatus 200 in accordance with embodiments of the present disclosure is shown. Test apparatus 200 includes a pressure vessel 210, an inner test cell 220, a screen assembly 230, and a piston 240 in sealing contact with an inner surface of pressure vessel 210. Piston 240 may be a thermoplastic piston, metal piston, or any other type known to those skilled in the art. Further, a pumping assembly 250 is connected to screen test apparatus 200 with a fluid line 252. Pumping apparatus 250 may include a pump 254, a fluid reservoir 256, a pressure regulator 258, and other components known to a person skilled in the art.

At least two fluids may be disposed within pressure vessel 210: a first fluid 260, which may be a hydraulic fluid such as water, configured to apply pressure to an upper surface of piston 240, and a second fluid 270, such as a workover fluid or fluid loss pill, configured to apply pressure to screen assembly 230. Test apparatus 200 may farther include a relief valve 225 disposed on test cell 220, and a relief valve 215 and a burst disc 217 disposed in a head cap 212 disposed on pressure vessel 210.

In one aspect, the screen test apparatus may be used as a relatively small-scale test device to pressurize a workover fluid against a sample section of a screen. It may be desired to hold a constant pressure and determine if a "seal" has been developed on the screen. In the event that a complete seal is not formed on the screen, a leak-off rate of workover fluid passing through the screen may be measured. In certain embodiments, the workover fluid may be SEAL-N-PEEL®, produced by M-I LLC of Houston, Tex., which is a fluid-loss control pill for sand-control completion applications. In certain embodiments, a testing apparatus may be configured to test alternate workover fluids known to those skilled in the art.

Referring still to FIG. 2, a test procedure as described below may be followed when using high pressure testing apparatus 200. Before testing, pressure vessel 210 and test cell 220 may be pressure tested to ensure they meet current pressure vessel standards using procedures known to those skilled in the art. Further, all fittings used may be rated to at least a working pressure of the system. In certain embodiments, the working pressure of the system may be about 5000 psi. Further, a relief system comprising relief valve 215 and burst disc 217 may be plumbed into the screen test apparatus. Relief valve 215, located in the end of pressure vessel 210, may ensure no trapped pressure will be present when head cap 212 is removed from pressure vessel 210. Burst disc 217 may ensure that pressure vessel 210 will not be pressurized past the design limit.

In certain embodiments, pressure vessel 210 may be filled with workover fluid 270. Screen assembly 230 may be assembled as shown in FIG. 3 and attached to an end of test cell 220. Test cell 220 and piston 240 may then be assembled together as a subassembly, and inserted into pressure vessel 210. After test cell 220 and piston 240 are inserted in pressure vessel 210, a hydraulic fluid 260, such as water, may fill a volume above piston 240. Head cap 212 may then be attached to pressure vessel 210 by bolting or other fastening methods known to those skilled in the art. Valve 215 may be opened and pumping assembly 250 activated to bleed the system. Pumping assembly 250 may include an air-powered hydraulic pump 254 or any other pumping device known to those skilled in the art to build and maintain pressure in pressure vessel 210. Further, pumping assembly 250 may include a reservoir 256 used to measure the amount of fluid required to maintain pressure on the system. Additionally, reservoir 256 may be used to monitor spurt-loss and leakage past the screen.

Hydraulic fluid 260 is pressurized by pumping assembly 250 and applies pressure on the surface of piston 240, which causes piston 240 to move in a downward direction. The downward movement of piston 240 applies pressure to workover fluid 270 resulting in pressure applied on screen assembly 230. The pressure inside pressure vessel 210 and applied to screen assembly 230 is increased to test whether screen assembly 230 seals/plugs or allows workover fluid 270 to pass therethrough. The measured workover fluid that is able to pass through screen assembly 230 may be analogous to leak-off through screen assembly 230 into test cell 220. In certain embodiments, gauge and/or regulator 258 and hand-lever kit (not shown) may be used to fine-tune the high pressure applied in the pressure vessel 210.

Figure 3A:
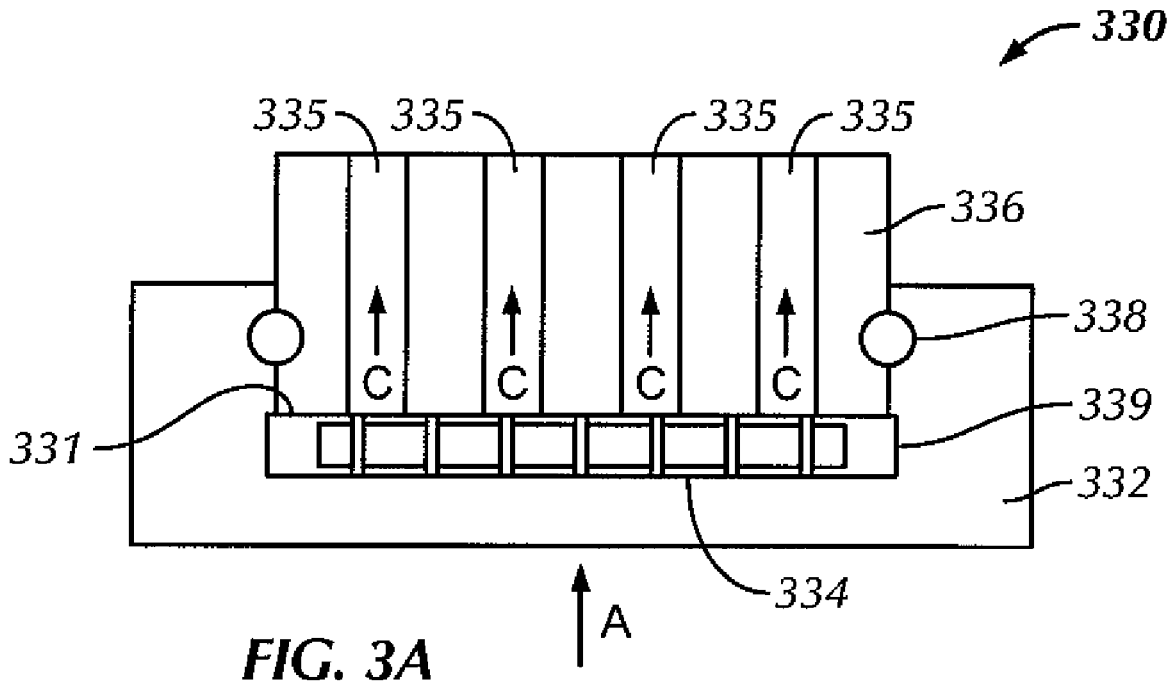
FIG. 3A is a section view of a screen assembly in accordance with embodiments of the present disclosure.

Referring now to FIG. 3A, a section view of screen assembly 330 in accordance with embodiments of the present disclosure is shown. Screen assembly 330 includes a mount collar 332, a screen 334 disposed in mount collar 332, and an end cap 336 adjacent screen 334. Screen assembly 330 may further include a seal 338 disposed between mount collar 332 and end cap 336. Seal 338 may be an o-ring, S-seal, or other known seals commonly used in the art. In certain embodiments, an adhesive material 339 may be disposed about a circumference of screen 334 and used to prevent screen 334 from separating from mount collar 332 at high pressures and also to prevent leakage around the screen. Adhesive material 339 may comprise an epoxy or any other adhesive/sealant known to a person skilled in the art. End cap 336 includes a plurality of passages 335 that extend through the entire thickness of end cap 336. End cap 336 also includes grooves (337 in FIG. 3B) formed in a face 331 adjacent screen 334.

Figure 3B:
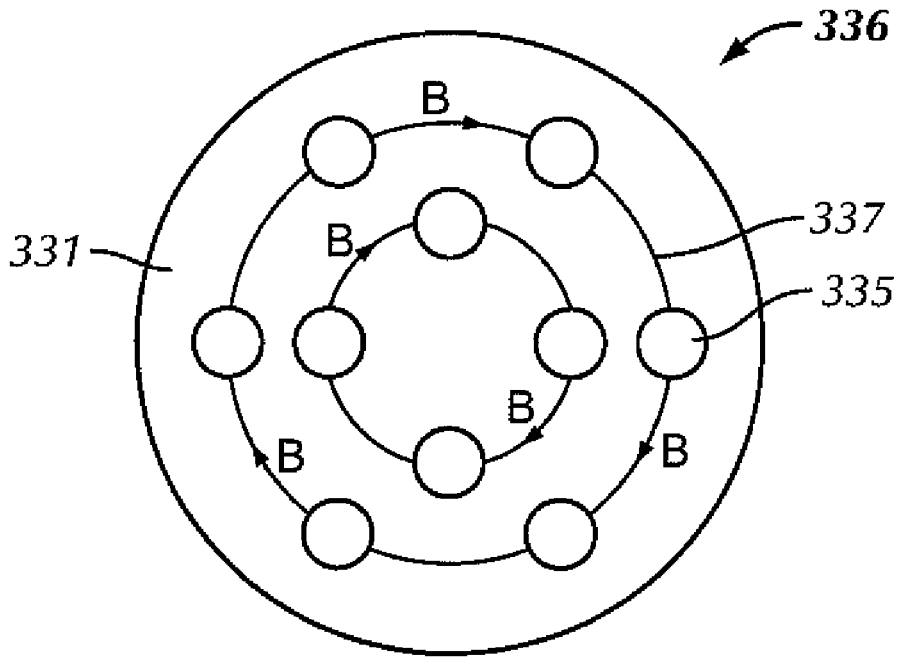
FIG. 3B is an end view of an end cap in accordance with embodiments of the present disclosure.

Referring to FIG. 3B, an end view showing face 331 of end cap 336 in accordance with embodiments of the present disclosure is shown. Passages 335 may be arranged in concentric circles. Grooves 337 connect to passages 335 to allow fluid to travel through screen assembly 330. In certain embodiments, passages may vary in diameter from about 1/16 inch to about 1/4 inch. Passages 335 and grooves 337 may be configured in various ways as will be known to a person skilled in the art. For example, grooves 337 may be arranged in a grid pattern (not shown) on a face of end cap 336. Also, while embodiments disclosed herein show circular cross-sectional passages, a person of ordinary skill in the art would understand that any number of various cross-sectional shapes may be used, including, but not limited to, square, triangular, and polygonal.

Embodiments disclosed herein include an end cap 336 having passages configured to allow workover fluid to pass through end cap 336 while being small enough so that the end cap 336 is capable of providing support for screen 334 against high pressures. In certain embodiments, pressures up to about 5000 psi may be applied to screen assembly 330 by workover fluid. End cap 336 is positioned immediately adjacent screen 334 to provide support when screen 334 is subject to increased pressures during testing. The added support of end cap 336 prevents deformation of screen 334.

As shown in FIG. 3A, workover fluid may enter screen assembly 330 (indicated by arrow "A") and first pass through screen 334. Workover fluid may proceed to flow into grooves 337 (indicated by arrows "B" in FIG. 3B), and follow a path created by grooves 337 until reaching passages 335. Grooves 337 may be necessary to allow workover fluid to flow through screen 334, because screen 334 may be immediately adjacent end cap 336. Workover fluid may then flow through passages 335 (indicated by arrows "C" in FIG. 3A) and exit end cap 336. In certain embodiments, screen 334 may comprise a circular wire-wrap screen test piece approximately 2 inches in diameter. It will be understood by those skilled in the art that a number of shapes and sizes of test screens may be used with embodiments disclosed herein. In certain embodiments, end cap 336 may include a curved surface (not shown) adjacent screen 334 for testing a curved screen. For example, the curved surface may be convex or concave with respect to screen 334.

Figure 4:
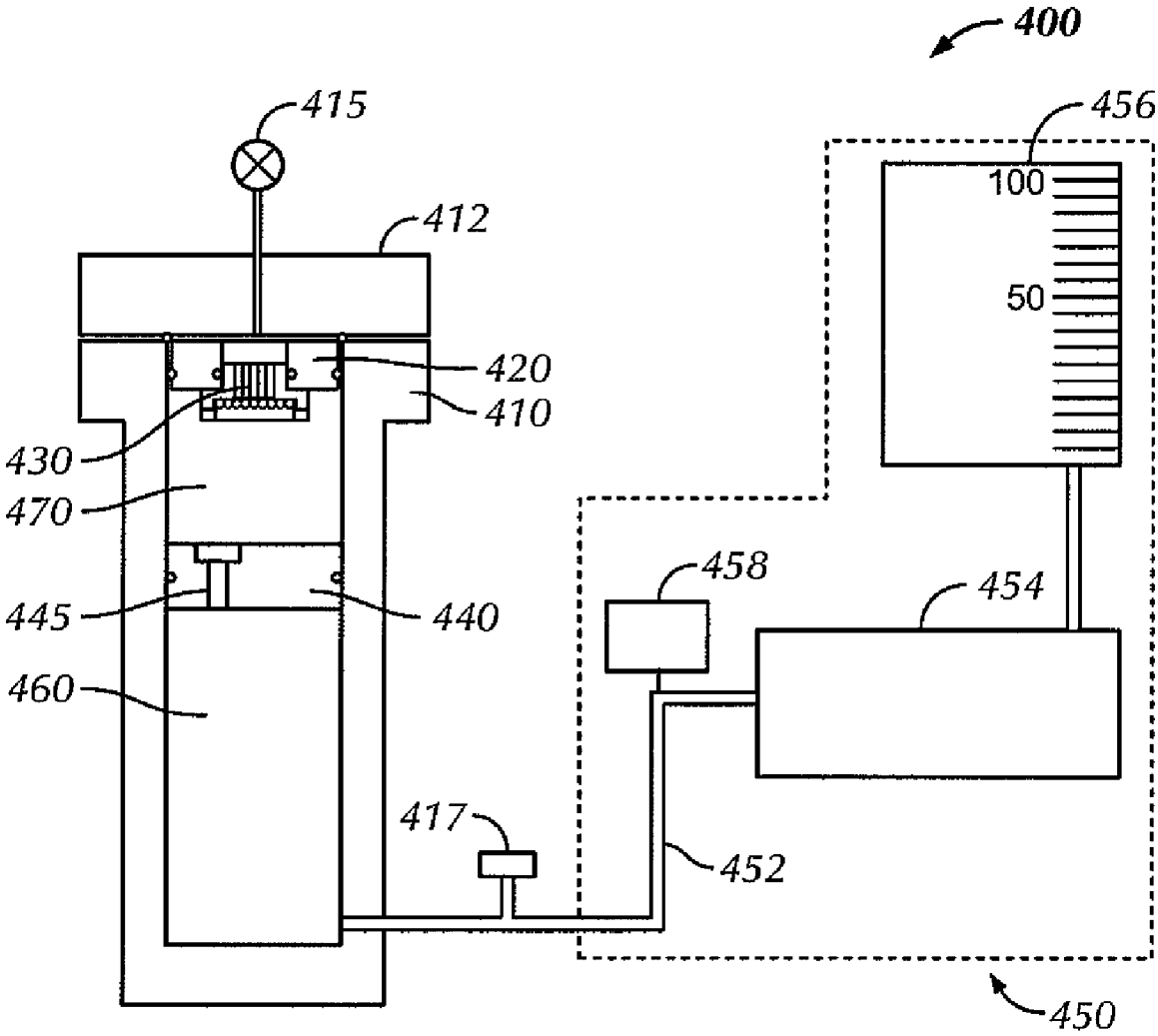
FIG. 4 is a schematic view of an alternative high pressure test apparatus in accordance with embodiments, of the present disclosure.

Referring now to FIG. 4, a schematic diagram of an alternative high pressure screen test apparatus 400 in accordance with embodiments of the present disclosure is shown. Test apparatus 400 includes a pressure vessel 410, a high temperature high pressure (HTHP) test cell 420, a screen assembly 430, and a piston 440 in sealing contact with an inner surface of pressure 410. Further, a pumping assembly 450 may be connected to screen test apparatus 400 with a fluid line 452. Pumping apparatus 450 may include a pump 454, a fluid reservoir 456, a pressure regulator/gauge 458, and other components known to a person skilled in the art.

At least two fluids may be disposed within pressure vessel 410: a first fluid 460 which may be a hydraulic fluid such as water, configured to apply pressure to piston 440, and a second fluid 470 such as a workover fluid or fluid loss pill, configured to apply pressure to screen assembly 430. Test apparatus 400 may further include a relief valve 415 and a burst disc 417 connected to test apparatus 400. Further, in this embodiment, piston 440 includes a bleed screw 445. Bleed screw 445 is configured to relieve the volume filled with hydraulic fluid 460 of air. Screen assembly 430 may be configured in a manner similar to the one described above with reference to FIG. 3 and attached at the top of pressure vessel 410 by fasteners or other methods known to those skilled in the art. In embodiments shown in FIG. 4, test cell 420 may not be volume limited because as much workover fluid 470 as needed may flow out of pressure vessel 410 through relief valve.

Referring still to FIG. 4, pressure vessel 410 may first be filled with hydraulic fluid 460, e.g., water, followed by placement of piston 440 on top of hydraulic fluid 460. Workover fluid 470 may then fill the remaining volume inside pressure vessel 410 above piston 440. Test cell 420 and screen assembly 430 may be assembled and disposed in an upper end of pressure vessel 410 as shown. End cap 412 may then be attached to pressure vessel 410, valve 415 may be opened, and pumping assembly 450 activated to bleed the system as described above.

To increase pressure, pumping assembly 450 pumps hydraulic fluid 460 into pressure vessel 410. As the pressure inside pressure vessel 410 increases, piston 440 moves upward (or towards screen assembly 430), thereby pressurizing workover fluid 470 and applying pressure to screen assembly 430. The pressure inside pressure vessel 410 and applied to screen assembly 430 is increased to test whether screen assembly 430 seals/plugs or allows workover fluid 240 to pass therethrough. The measured workover fluid 470 that is able to pass through screen assembly 430 may be analogous to leak-off through screen assembly 430 into test cell 420, as previously discussed.

Figure 5:
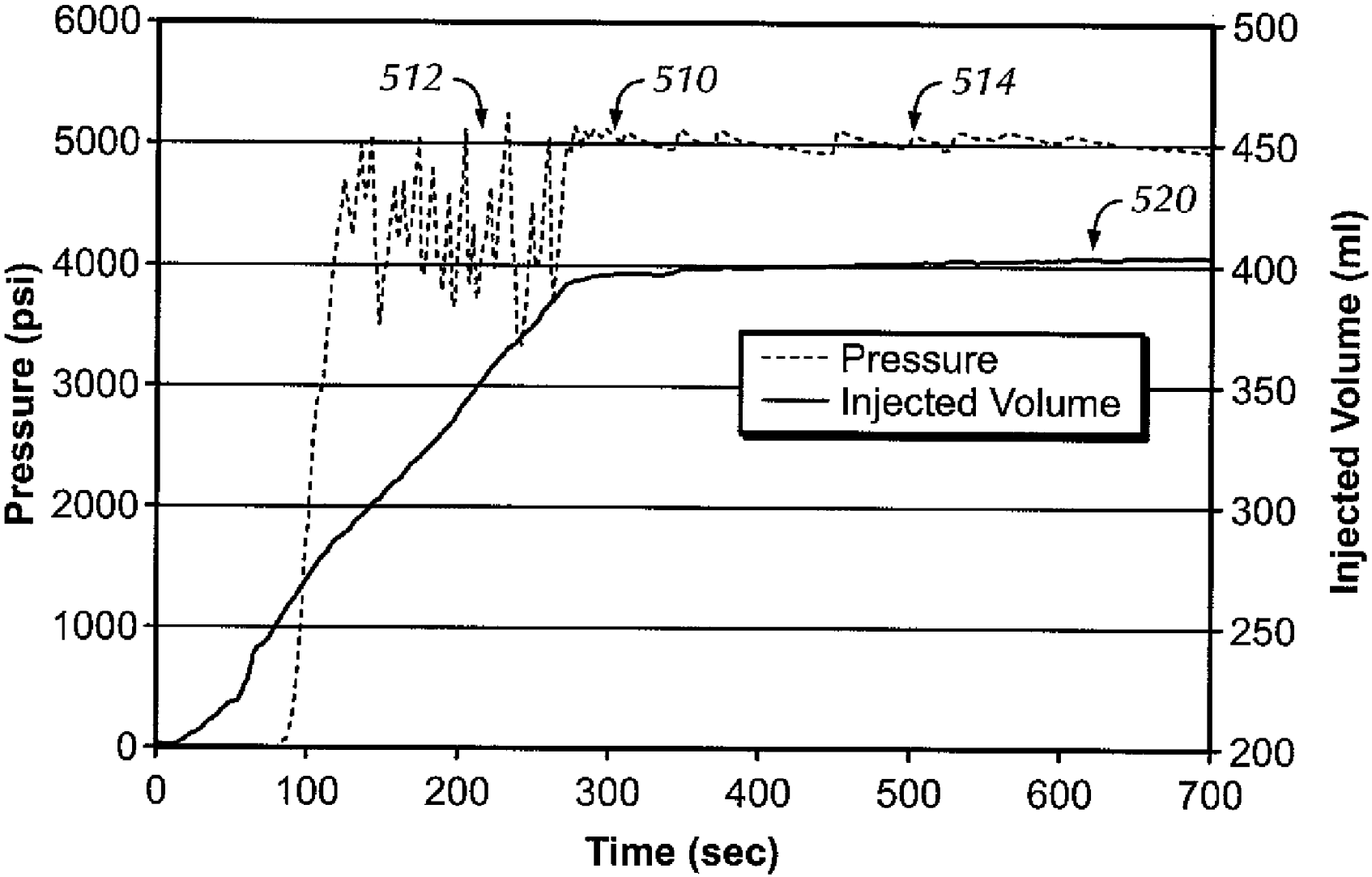
FIG. 5 is a graph of pressure and injected fluid volume vs. time during testing of a test apparatus in accordance with embodiments of the present disclosure.

Test results performed with the high pressure screen test apparatus show that the screen was intermittently plugged by the workover fluid. Referring to FIG. 5, a chart showing the pressure applied on the screen 510 and volume of fluid pumped into the system 520 over a period of time in accordance with embodiments of the present disclosure is shown. Fluctuations in pressure 510 shown in the chart may have been caused by instances when the workover fluid was able to leak through the screen into the test cell. For example, the workover fluid may clog the screen for a period of time until the constant high pressure causes an amount of the workover fluid to leak into the test cell, followed by more fluid quickly replacing the lost fluid and clogging the screen again. Hydraulic fluid was constantly applied by a hand pump in an attempt to maintain a relatively constant pressure. When the pressure increased to 5000 psi and remained substantially constant, the test was stopped.

As shown in FIG. 5, the screen was plugged intermittently for a period of time 512, after which the workover fluid appeared to effectively clog the screen for the remaining time 514 and hold the pressure. Gap measurements of the wire screen mesh were taken before and after the test, with no measurable deformation occurring on the screen. The workover fluid was tightly packed into the screen, requiring manually loosening it with a pick and then washing it away with a dilute acid solution. It is noted that the pressure shown in FIG. 5 may not fully represent the pressure differential across the screen. As the screen leaks, it may fill the constant volume vessel, or test cell, that is initially at atmospheric pressure. As the vessel is filled, pressure builds and lowers the differential across the screen.

In certain embodiments, a screen test system may include an automated control system to perform the testing procedures. For example, a control system may apply pressure to the screen testing apparatus up to a user-defined setpoint, at which point the control system may automatically relieve the pressure from the system. In certain embodiments, a temperature control may be added or integrated into the screen test apparatus for testing the workover fluid at varying temperatures so as to test screens and fluids at actual downhole conditions. The temperature control may be configured to increase testing temperatures up to, for example, 250-300° F. Further, a data acquisition system may be used to track and record data collected during testing of the screen test apparatus. Data may be tracked and/or viewed with a computer screen, handheld device, or other devices known to those skilled in the art. Further, a data storage device may be integrated or connected to the data acquisition system for storing data and compiling historical test data for comparison purposes.

Advantageously, embodiments of the present disclosure may provide a test apparatus capable of more closely simulating increased downhole pressures on the screens. Because of the improved support for the screen to prevent deformation under test conditions, more accurate and realistic data may be obtained to determine whether the downhole screens will effectively and reliably seal when needed. Previously, under higher test pressures, the screens may have deformed slightly and changed dimension which resulted in fluid leaks around the screen. The fluid leaks served to invalidate the testing, as it could not be determined whether the screen or the workover fluid had failed. Embodiments of the present disclosure may provide a screen test apparatus which may prevent screen deformation under high pressure tests, and therefore attention may be focused on determining whether a workover fluid loading on the screen is effectively sealing under higher pressures.

Embodiments of the present disclosure may advantageously provide a relatively smaller testing apparatus that is easier to assemble and use. Rather than conducting tests on large screens, embodiments disclosed herein provide a smaller, yet reliable, sample screen. Further, the smaller screen test apparatus may reduce costs from running the tests and collecting data. Because of the reduced costs of conducting tests using embodiments disclosed herein, more frequent tests may be conducted which allow more data to be acquired. Therefore, a wide range of workover fluids may be tested in a short amount of time at various desired pressures to determine the feasibility of using them in downhole operations.

Further, embodiments disclosed herein may provide a testing apparatus capable of higher test pressures than before. As drilling and producing operations continue to deeper depths in deeper water, higher pressures may be encountered. The ability to simulate these downhole conditions at a fraction of previous costs prior to inserting components into operation may be well received in industry. Further, knowledge of the workover fluid capabilities and screen yield-pressure limitations prior to actual downhole use may prevent or at least reduce the number of failures during a workover of a wellbore due to leaks into the producing formation or to screen collapse. Because of extremely high rig costs, the assurance of the reliability of workover fluids and completion screens obtained from high quality test data collected using embodiments disclosed herein may be well received in industry.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

What is claimed:

1. A screen test apparatus comprising:
a test cell disposed within a pressure vessel;
a piston disposed within the pressure vessel, wherein the piston is in sealing contact with an inner surface of the pressure vessel; and
a screen assembly disposed in an end of the test cell, the screen assembly comprising:
a mount collar;
a screen disposed in the mount collar;
an end cap adjacent the screen comprising grooves in a face adjacent the screen and passages extending through the end cap;
wherein the screen assembly is configured to fully support the screen while allowing a fluid to pass through the screen.

2. The apparatus of claim 1, further comprising a relief valve disposed in the test cell.

3. The apparatus of claim 1, wherein the screen comprises a wire wrap screen.

4. The apparatus of claim 1, further comprising an automated control system.

5. The apparatus of claim 1, further comprising a data acquisition system.

6. The apparatus of claim 1, wherein the screen assembly is configured to simulate downhole screens.

7. The apparatus of claim 1, wherein the grooves are arranged in concentric circles in the face of the end cap.

8. The apparatus of claim 1, wherein the passages are between about 1/16 inch and 1/4 inch in diameter.

9. The apparatus of claim 1, further comprising a hydraulic fluid and a workover fluid disposed in the pressure vessel and separated by the piston.

10. The apparatus of claim 1, further comprising a bleed screw disposed in the piston.

11. The apparatus of claim 10, wherein the bleed screw is configured to remove air from the pressure vessel.

12. A screen test system comprising:
a pumping assembly comprising:
a pump, a fluid reservoir, and a pressure regulator;
a screen test apparatus comprising:
a test cell disposed within a pressure vessel;
a piston disposed within the pressure vessel, the piston in sealing contact with an inner surface of the pressure vessel;
a screen assembly disposed in the test cell, the screen assembly comprising:
a mount collar;
a screen disposed in the mount collar;
an end cap adjacent the screen comprising grooves in a face adjacent the screen and passages extending through the end cap;

a fluid line connecting the pumping assembly to the screen test apparatus;

a workover fluid to apply pressure to the screen assembly; and a hydraulic fluid to apply pressure to the piston.

13. The system of claim 12, further comprising a data acquisition system.

14. The system of claim 12, further comprising an automated control system.

15. A method of testing a screen with high pressure, the method comprising:

disposing a test cell and a piston within a pressure vessel, such that the piston is in sealing contact with an inner surface of the pressure vessel;

disposing a screen assembly in the test cell, the screen assembly comprising:

a mount collar;

a screen disposed in the mount collar;

an end cap adjacent the screen comprising grooves in a face adjacent the screen and passages extending through the end cap;

filling a volume in the pressure vessel between the piston and the test cell with a workover fluid, the workover fluid configured to apply a pressure against the screen assembly;

filling a remaining volume in the pressure vessel with a hydraulic fluid, the hydraulic fluid configured to apply pressure to the piston;

applying pressure from a pumping assembly with the hydraulic fluid to the piston; and applying pressure with the workover fluid to the screen assembly;

wherein the workover fluid applied to the screen assembly is pressurized to determine sealing characteristics.

16. The method of claim 15, further comprising using a high precision regulator to fine-tune the pressure applied in the pressure vessel.

17. The method of claim 15, further comprising measuring a leak-off rate of workover fluid flowing through the screen.

18. The method of claim 15, further comprising measuring an amount of workover fluid needed to completely seal the screen.

* * * * *